US006419610B1

(12) United States Patent
Jonas et al.

(10) Patent No.: US 6,419,610 B1
(45) **Date of Patent: *Jul. 16, 2002**

(54) CLIMBING WALL

(75) Inventors: Kenneth J. Jonas; Randall C. Grutza, both of Janesville; Matthew T. Bolland, Stoughton, all of WI (US)

(73) Assignee: PlayCore Wisconsin, Inc., Chattanooga, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/663,641

(22) Filed: Sep. 15, 2000

Related U.S. Application Data

(63) Continuation of application No. 08/873,166, filed on Jun. 11, 1997, now Pat. No. 6,193,633.

(51) Int. Cl.[7] ..... A63B 17/00
(52) U.S. Cl. ..... 482/35; 482/37; 446/110
(58) Field of Search ..... D21/244, 113; 482/35, 37, 7, 148; 446/120, 118, 86, 121, 128, 123, 110; 52/604, 605, 606, 592.1, 592.2, 592.6

(56) References Cited

U.S. PATENT DOCUMENTS

| | | | |
|---|---|---|---|
| D223,460 | S | 4/1972 | Ahrens |
| D227,754 | S | 7/1973 | Newberry, Jr. |
| 3,751,827 | A | 8/1973 | Gaskin |
| 4,270,748 | A | 6/1981 | Ray |
| 4,546,965 | A | 10/1985 | Baxter et al. |
| 4,940,558 | A | 7/1990 | Jarboe et al. |
| D316,134 | S | 4/1991 | Gianacakos |
| 5,055,327 | A | 10/1991 | Baskin |
| 5,125,877 | A | 6/1992 | Brewer |
| 5,242,652 | A | 9/1993 | Savigny |
| 5,254,058 | A | 10/1993 | Savigny |

(List continued on next page.)

FOREIGN PATENT DOCUMENTS

| | | |
|---|---|---|
| DE | 1111554 | 7/1961 |
| DE | 64998 | 2/1979 |
| DE | 3905471 A1 | 8/1990 |

OTHER PUBLICATIONS

"Big Toys ® 10 Plus ®"Kompan, Inc., date unknown.
"Safety Surfacing" © 1996 Kompan, Inc.

(List continued on next page.)

*Primary Examiner*—Jerome W. Donnelly
(74) *Attorney, Agent, or Firm*—Lathrop & Clark LLP

(57) ABSTRACT

A truncated triangular inclined climbing wall is attached to a wooden play structure, and is tilted at about a forty-eight degree angle against the play structure, and is fastened by a flange to an elevated deck which is accessible through a wood framed inlet. The climbing wall is staked to the ground, and narrows from a wide, ground-engaging, base, to a narrower summit, which is immediately adjacent the framed inlet. The climbing wall is formed with a number of rock-simulative ledges, which progress from the base to the summit. Each molded ledge preferably has a child-graspable hand grip integrally molded in the riser. The top surfaces of the step-like ledges define treads which are inclined from the horizontal to direct the child's foot inward toward the climbing wall rather than away from the wall and off the structure. To contribute to the rock-simulative visual effect of the thermoformed plastic assembly, polyethylene is extruded with a pattern of streaks or striations which, when molded, simulate the color variations of naturally occurring rock formations. The hypotenuse of the triangle provides both a climbing surface and a means for directing climbing children to the inlet.

11 Claims, 3 Drawing Sheets

U.S. PATENT DOCUMENTS

| | | | |
|---|---|---|---|
| 5,269,991 | A | 12/1993 | Gueret |
| 5,334,098 | A | 8/1994 | Pope et al. |
| 5,352,166 | A | 10/1994 | Chang |
| D366,512 | S | 1/1996 | Ziegler, Jr. et al. |
| D370,957 | S | 6/1996 | Erlick |
| 5,543,185 | A | 8/1996 | Christensen |
| D379,670 | S | 6/1997 | Karanikas |
| 5,644,873 | A | 7/1997 | Bourgault |
| 5,688,839 | A | 11/1997 | Royce |
| D392,363 | S | 3/1998 | Jonas |
| 5,827,105 | A | 10/1998 | Felgenhauer et al. |

OTHER PUBLICATIONS

"GROUNDS for PLAY$^{SM}$ creative play environment, climbing a tree,. . ." Date unknown.

"GROUNDS for PLAY$^{SM}$ creative play environments We make playground FUNctional!" Date unknown.

"OLYMPIC RECREATION" Date unknown.

"Corporate Sales Fall 1996 little tikes ® fun that lasts™" Date unknown.

JCPenney Spring 1997 Catalog presents little tikes ® fun that lasts™ © 1997 J.C. Penney Company, Inc.

"JUST for FUN!" © 1996 Creative Playgrounds, Ltd.

"TimberForm ® & PipeLine ® Playground Equipment Catalog" © 1996, selected unnumbered pages.

"PLAYKIDS PLAYGROUNDS 1997 Product Line" © 1996 Playkids Manufacturing Inc.,.

"EXPLORE THE FUN!" © 1996 Little Tikes ® Commercial Play Systems Inc., Farmington, MO, selected unnumbered pages.

Newspaper clipping from The Journal, Robert Bell, Jul. 12, 1990, 1 pg.

Mega Rock, GameTime, Inc., 2 pages, Fort Payne, AL.

"Indoor climbing unique way to hang onto fitness", The Washington Times, Karen Goldberg Goff, Feb. 15, 1998, 2 pgs.

"Swing–N–Slide® SideWinderSlide™," Swing–N–Slide Corp., Janesville, WI.

CLIMBING WALL

CROSS REFERENCES TO RELATED APPLICATIONS

This application is continuation of U.S. application Ser. No. 08/873,166, filed Jun. 11, 1997, now U.S. Pat. No. 6,193,633, the disclosure of which is incorported by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to playground equipment in general, and to climbing accessories for play structures in particular.

Energetic outdoors activities have always enthralled children, and recent parental attitudes towards physical fitness and exercise have contributed to an increased attention to the need to provide children with recurring opportunities for routine moderate physical exertion. With only a small fraction of the nation's children being raised in farm households, most families cannot rely solely on the benefits of rural activities requiring a great deal of space. Restrictive parental schedules and security concerns have also contributed to a need to keep the children close to home for their play activities.

Outdoors play structures economically and effectively address children's exercise needs in the context of play. While once built primarily of steel tubing, many residential play structures are now constructed of treated timbers. These structures can readily be constructed by a hobbyist or craftsman of moderate skill, and the variety of connection systems available make possible a wide range of play structure configurations. Slides, ladders, ropes and rope bridges, tunnels, and balance beams are available for convenient connection to a wooden play structure.

In addition to contributing to physical fitness, play activities also build important mental skills, especially those involving imagination, creative thinking, teamwork and leadership. Play structures which challenge a child's imagination and spark creative play are especially desirable.

Climbing walls of plaster, concrete, or stone have long been used by mountaineers and spelunkers to test their climbing skills and to challenge their stamina and grip strength in a controlled environment. Although such highly vertical walls would be appealing to small children, they are costly and require the use of safety lines, carabineers, and other mechanical equipment not suitable for those of a young age group. Conventional climbing walls, moreover, are typically constructed on site, and hence require a level of skill and cost not readily available to the homeowner.

What is needed is an economical play structure accessory which simulates a rock wall in a manner which is both intriguing and accessible to children, and which can be mass produced for shipping.

SUMMARY OF THE INVENTION

The play structure climbing wall of this invention is economically produced by the single sheet thermoforming process. To facilitate shipping, the wall is formed in multiple elongated segments which are bolted together when attached to the wooden play structure. The climbing wall is tilted at about a forty-eight degree angle against the play structure, and is fastened by a flange to an elevated deck which is accessible through a wood framed inlet. The climbing wall is staked to the ground, and narrows from a wide ground-engaging base, to a narrower summit, which is immediately adjacent the framed inlet. The climbing wall is formed with a number of rock-simulative ledges, which progress from the base to the summit. Each molded ledge preferably has a child-graspable hand grip integrally molded in the riser. The top surfaces of the step-like ledges form treads which are inclined from the horizontal to direct the child's foot inward toward the climbing wall rather than away from the wall and off the structure. To contribute to the rock-simulative visual effect of the thermoformed plastic assembly, polyethylene is extruded with a pattern of streaks or striations which, when molded, simulate the color variations of naturally occurring rock formations. The climbing wall has two side-by-side upper segments which can be mounted to a play structure with a low deck. For taller decks, a single base segment is mounted below the two upper segments. The three segment assembly is shaped generally like a truncated right triangle, with the hypotenuse of the triangle providing both a climbing surface, and a means for directing climbing children to the inlet.

It is an object of the present invention to provide a climbing wall for a play structure which can be manufactured economically.

It is another object of the present invention to provide a climbing wall for a play structure which can be shipped knocked down in a size less than the final assembly size.

It is a further object of the present invention to provide a climbing wall for a play structure which has visible surface markings which simulate natural patterns.

It is also an object of the present invention to provide a climbing wall for a play structure which can be attached to a play structure in place of a slide.

It yet another object of the present invention to provide a climbing wall for a play structure which tends to direct climbers toward the wall rather than away from it.

It is a still further object of the present invention to provide a climbing wall for a play structure which directs climbing children to an appropriate entrance at an elevated level on the play structure.

Further objects, features and advantages of the invention will be apparent from the following detailed description when taken in conjunction with the accompanying drawings.

DESCRIPTION OF THE PREFERRED EMBODIMENT

Figure 1:
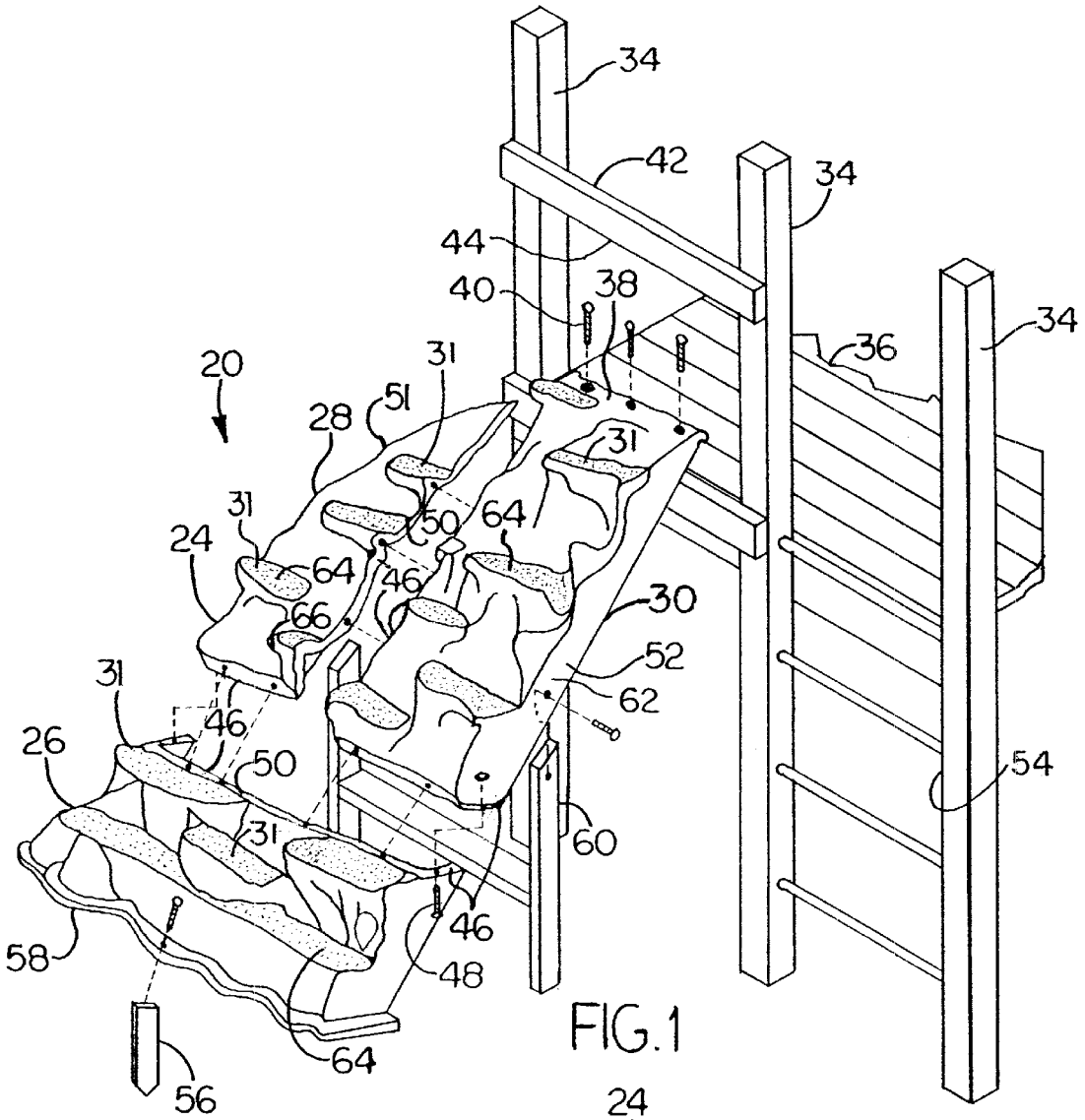
FIG. 1 is an exploded isometric view of the climbing wall of this invention.

Referring more particularly to FIGS. 1–4, wherein like numbers refer to similar parts, a climbing wall 20 is shown in FIG. 1. The climbing wall 20 is for attachment to a children's outdoor play structure 22, for example, one of the type constructed of conventional dimensioned timber beams. The climbing wall 20 has a simulated rock face 24 which is defined by three single-sheet thermoformed polyethylene segments 26, 28, 30. A base segment 26 extends along the ground 32, and the two upper segments 28, 30 are bolted to the base segment. The simulated rock face 24 has an array of projecting ledges 31 which serve as steps and handholds for children to climb upon.

Figure 2:
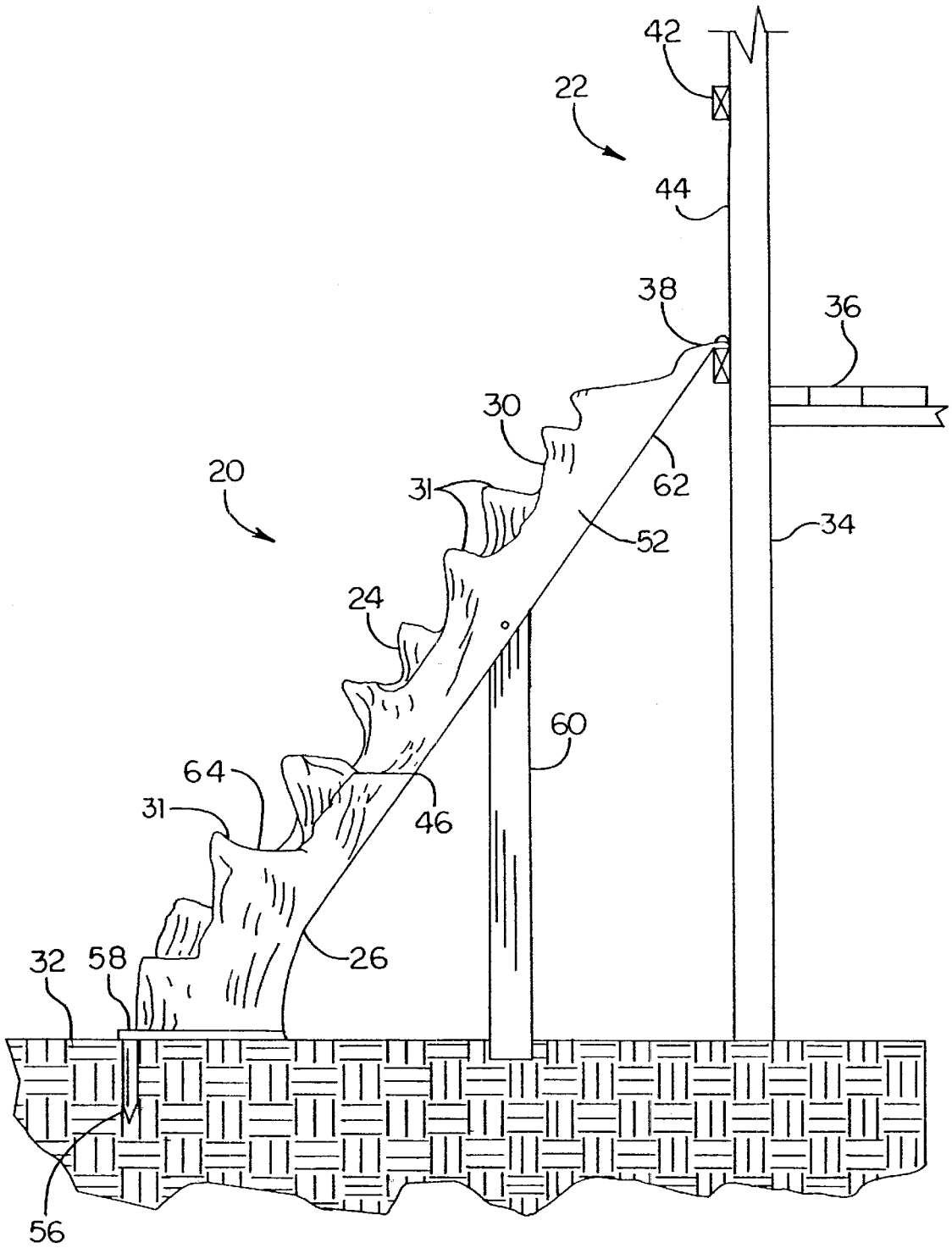
FIG. 2 is a side elevational view of the climbing wall of FIG. 1.

As shown in FIG. 2, the simulated rock face 24 of the climbing wall 20 is an irregular high relief surface which is inclined with respect to the horizontal approximately 48 degrees. The play structure 22, as shown in FIG. 1, has vertical timbers 34 which support an elevated deck 36. The height of the deck 36 above the ground 32 will vary, for example between forty-eight inches and sixty-six inches. The upper attachment segment 30 of the climbing wall 20 has a horizontally extending flange 38 which is fastened by lag bolts 40 to the play structure to discharge a climber onto the deck 36. The play structure 22 will preferably have vertical timbers 34 extending upwardly on either side of the climbing wall attachment flange 38, as well as a lintel member 42 which extends above the deck 36 at below head level to define a play structure inlet 44. The inlet 44 is the opening in the play structure 22 through which children can gain access to the elevated deck 36.

As shown in FIG. 1, each thermoformed climbing wall segment 26, 28, 30 has a connecting flange 46 which extends away from the simulated rock face 24. The connecting flanges 46 of adjacent wall segments are connected through pre-drilled holes by fasteners 48. Although the simulated rock face 24 has an irregular surface, the flanges 46 preferably extend along continuous horizontal or vertical joint seams 50 for convenient connection of the wall segments 26, 28, 30. The wall is formed of multiple segments for several reasons. First, economies in shipping can be realized by shipping long and narrow parts, as opposed to larger, more square parts. In addition, successful thermoforming of parts is facilitated by limiting overall part size. Finally, by making the climbing wall as an assembly of two upper segments 28, 30, and a single lower segment, the wall is easily adapted to lower deck heights by omitting entirely the base segment 24. For a forty-eight inch deck, for example, just the attachment segment 30 and the triangular upper segment 28 can be connected together and mounted by the flange 38 to the deck. For taller decks all three segments may be used.

As an example of how the climbing wall may be split, the base segment may be approximately 60 inches wide where it engages the ground, and 57 inches wide where it connects to the upper segments. The vertically extending length along the part of the base segment may be about 26 inches. The attachment segment and the triangular upper segment may each be 28½inches wide, with the attachment segment extending about 78 inches vertically along the length of the part.

Figure 3:
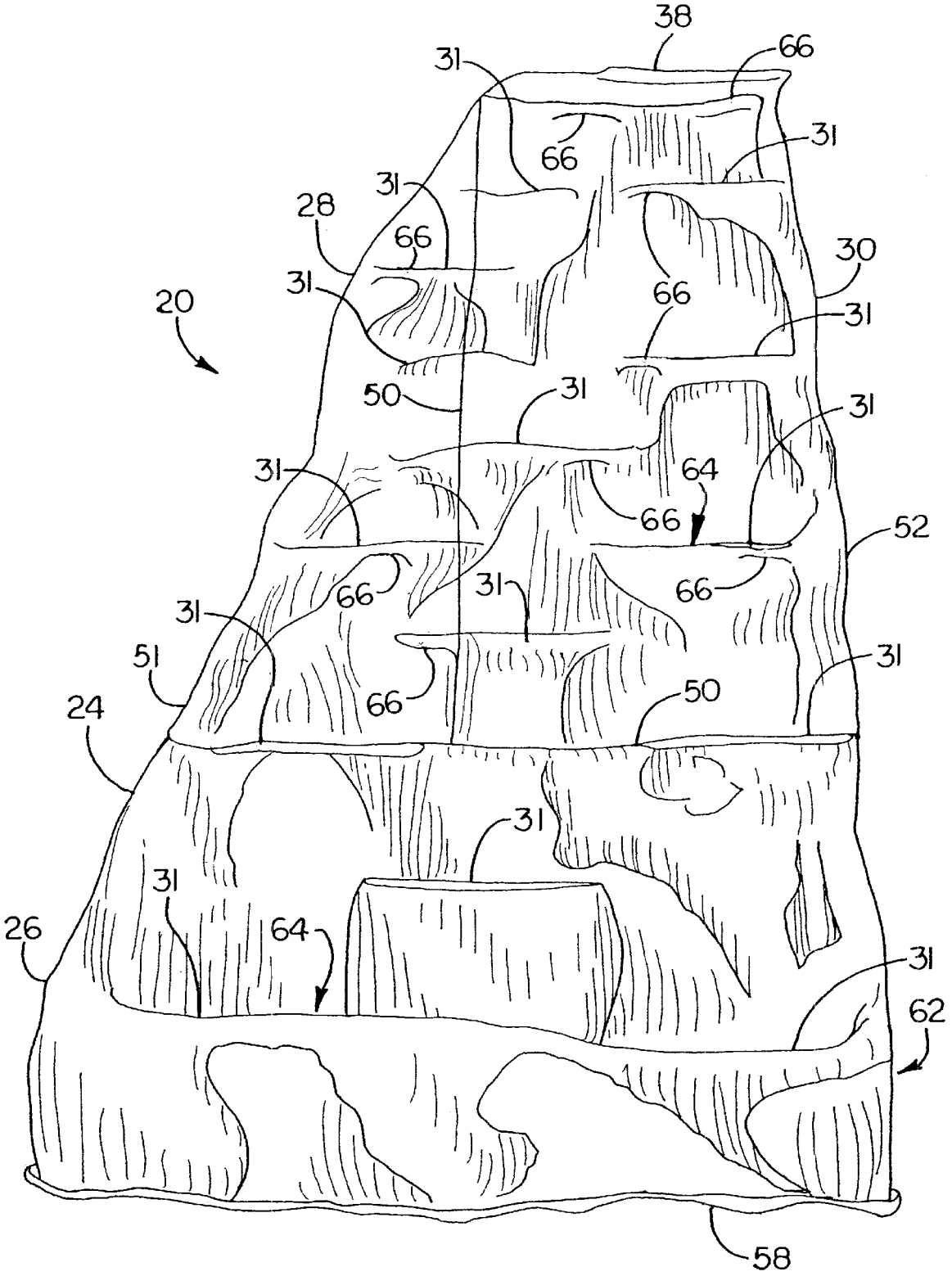
FIG. 3 is a front elevational view of the climbing wall of FIG. 1.

As shown in FIG. 3, the climbing wall is preferably formed with an irregular inclined side 51 and a generally vertical side 52. The vertical side 52 permits convenient mounting of the climbing wall 20 to pre-existing installed play structures 22 as a substitute for a slide. Conventional play structures often have a slide leading to a ledge, with a climbing ladder 54 alongside the slide. The climbing wall 20 can be substituted for a slide in such a play structure, and the vertical side 52 will not obstruct the climbing ladder 54. The inclined side 51 creates a narrowing of the horizontal width of the climbing wall 20 as it extends upwardly. Not only does the inclination contribute to the simulation of a natural rock outcropping, it also serves to direct climbing children into the play structure inlet 44. Hence multiple children can sit or climb on the lower portions of the simulated rock face, but, as the rock face extends upwardly, the narrowing in the horizontal direction tends to reduce the number of children, and the supported weight, which is higher up on the wall 20.

To restrain the climbing wall 20, a wooden stake 56 may be screwed to a ground engaging flange 58 which extends outwardly from the base segment 26. The stake 56 is pounded into the ground and helps to prevent outward creep of the base of the climbing wall. An intermediate wooden brace 60 may be fastened to the climbing wall at a midpoint between the stake 56 and the play structure 22 to impart greater rigidity to the assembly. The brace 60 may be formed of two vertical two-by-four timbers connected by a single horizontal two-by-four timber. The angled upper ends of two vertical timbers may be screwed to a side flange 62 of the upper segments 28, 30, and the lower portions of the vertical timbers may be buried in the ground.

The simulative ledges 31 are arranged in an alternating pattern extending from the base of the climbing wall to the summit. The ledges 31 serve both as steps and handholds for climbing children. The ledges are sculpted to as much as practicable have a random, natural rock appearance, but in general each ledge 31 is approximately 16 inches wide and extends eight inches toward the play structure 22. The ledges may be arranged in various patterns to facilitate climbing and play activities, however, in the illustrated climbing wall 20, as shown in FIG. 3, two ledges at a level alternate with a single ledge at the next higher up level, until the climbing wall narrows sufficiently that only two ledges can fit horizontally, at which point the ledges alternate one to a level. Serving as steps the ledges permit children to stand, sit, or crawl on the climbing wall.

To facilitate ease of climbing, the top surfaces 64 of each ledge, corresponding to the tread of a stair step, is inclined toward the play structure 22 by approximately 10 to 20 degrees. By sloping toward the play structure 22, the ledge top surfaces 64 urge a climber into closer engagement with the simulated rock face 24, making ascending the climbing wall easier. As shown in FIG. 2, although the ledge top surfaces 64 are inclined away from the horizontal, because of the inclination of the installed climbing wall segments, it is not necessary to mold undercut features in the thermoforming process to obtain the ledges.

Each ledge is also provided with a protruding handhold 66 which is approximately one-and-a-half inches tall, and three inches wide. The top surface of the handhold is continuous with the ledge top surface 64, and allows a child to grip the upper ledges while navigating between the lower ledges. To assist in frictional engagement between the climbers and the wall, the plastic sheet from which the climbing wall is formed may be formed with a pebbled non-slip texture, or the thermoforming molds themselves may have a texture for forming such a non-slip texture.

Figure 4:
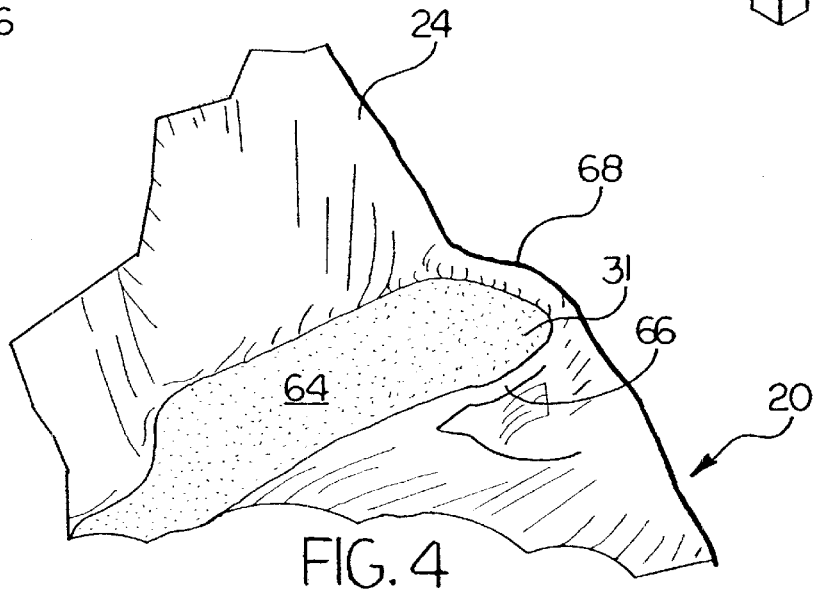
FIG. 4 is a fragmentary isometric view of a ledge of the climbing wall of FIG. 1.

As shown in FIG. 4, the ledges 31 on the outside edges of the climbing wall 20 may be molded with an upstanding lip 68, to further provided improved holding of a climber's foot on the structure. The lip 68 may extending upwardly from one-quarter inch to one inch.

Play structure accessories of thermoformed plastic have typically been formed in solid colors. Bright colors have been found to be appealing to the youthful eye, and can convey a message of fun and enthusiasm. Rock formations in nature, however, are rarely uniformly colored. The climbing wall 20, although in fact highly structured and engineered for optimum play satisfaction, is intended to simulate a naturally occurring rock formation, yet without the hard surfaces or sharp edges which could interfere with casually dressed climbers. The sculptural shapes and masses of the climbing wall suggest rock shapes, yet in a preferred embodiment the molded plastic itself is imbued with molded-in color variations which deepen the naturalistic effect of the climbing structure.

Few rock structure in nature are of a continuous tone. To mimic the effect of geological features such as lenticular inclusions, bedding and fold lines, and other stratigraphic features, the initial polyethylene sheets from which the three climbing wall segments are formed are extruded with a mottled or streaked surface. Because of the abrasion constant play and climbing will inflict on the plastic segments, it is important that any coloration be integral with the plastic, and not merely applied.

The rock strata simulating coloring is applied to the polyethylene sheets in the sheet extrusion process. Generally in a conventional sheet extrusion operation, top and bottom extrusion dies ten to fourteen feet wide are spaced parallel to one another to form a gap through which molten or semi-molten plastic is ejected onto rotating rolls where the plastic is cooled, and processed through subsequent dimensioning and finishing rolls, and perhaps a water bath. In a coextrusion process different colors or types of plastic are processed through the extrusion dies simultaneously.

The climbing wall segments, for example, may be formed from extruded polyethylene sheet which is about 0.350 inches thick. This sheet will be a coextrusion of a substrate layer of lower-cost black plastic, which might be about 0.342 inches thick. The top surface of the sheet, about 0.08 inches thick, will be a combination of a grey plastic base and streaks or blotches of different colors, for example brown or red. The dark black color of the substrate layer may show through the thin colored layer, but that can contribute to the natural variation of the surface coloration. The blotches and streaks are added to the sheet in the extrusion process by disposing plastic injecting nozzles ahead of the extrusion dies, and adding quantities of colored plastic to the substrate layer as it is extruded from the extrusion dies.

To form the climbing wall segments, a streaked and blotched polyethylene sheet is oriented in a thermoforming mold so that the streaks are generally aligned with the direction of the horizontal ledges. The polyethylene sheet is heated, and drawn into the single thermoforming mold to form one of the segments of the climbing wall. The molded sheet is then removed from the mold, trimmed, and the various connection holes are drilled in the appropriated flanges.

It is understood that the invention is not limited to the particular construction and arrangement of parts herein illustrated and described, but embraces such modified forms thereof as come within the scope of the following claims.

We claim:

1. A climbing wall assembly for attachment to a play structure, the assembly comprising at least one plastic segment having a thermoformed irregular high relief structure having a plurality of simulated rock ledges integrally formed thereon, the plastic segment having portions defining a simulated rock face which extends from ground level to an inlet of a play structure, the simulated rock face being inclined with respect to the horizontal, and wherein the simulated rock face narrows substantially as it extends from ground level to the play structure inlet, thereby limiting the number of children who can simultaneously enter the play structure through the inlet, the ledges providing treads for climbing thereon, and wherein a flange extends horizontally from an upper portion of the climbing wall for engagement with and attachment to the play structure.

2. The climbing wall assembly of claim 1 wherein the second plastic segment extends alongside and is fastened to the first segment, and the second segment rock face shape is substantially triangular.

3. A climbing wall assembly for attachment to a play structure, the assembly comprising at least one single sheet thermoformed plastic segment having a thermoformed irregular high relief structure having a plurality of simulated rock ledges integrally formed thereon, the plastic segment having portions defining a simulated rock face which extends from ground level to an inlet of a play structure, the simulated rock face being inclined with respect to the horizontal, and wherein the simulated rock face narrows substantially as it extends from ground level to the play structure inlet, thereby limiting the number of children who can simultaneously enter the play structure through the inlet, the ledges providing treads for climbing thereon; wherein each ledge has a tread which protrudes frontwardly for climbing thereon, and wherein the treads are inclined toward the rock face to urge a climber against the rock face rather than away from the rock face.

4. The climbing wall assembly of claim 1 wherein the ledges are formed on the simulated rock face to alternate between two ledges on a first level, and a single ledge on a level immediately above the first level.

5. The climbing wall assembly of claim 1 wherein the climbing wall plastic segments are each formed from a sheet of polyethylene having a plurality of colored streaks formed therein.

6. The climbing wall assembly of claim 1 wherein at least one ledge is on the side of the climbing wall, and a lip extends upwardly from the tread to the side of the tread to restrain a foot placed thereon from moving off the climbing wall.

7. A children's play assembly comprising:

a play structure having at least two upwardly extending beams on either side of an elevated deck, an inlet to the deck being defined between the two beams; and a climbing wall formed of thermoformed thermoplastic material, the climbing wall having a simulated rock face formed thereon and facing outwardly, the climbing wall extending from a base adjacent the ground to the deck, and the simulated rock face having a plurality of integrally formed protruding plastic ledges, the ledges providing surfaces for children to climb on to traverse the climbing wall from ground to the deck inlet, wherein the simulated rock face is narrower adjacent the deck than at the base, and wherein a flange extends horizontally from an upper portion of the climbing wall, the flange being fastened to the play structure elevated deck within the inlet.

8. A children's play assembly comprising:

a play structure having at least two upwardly extending beams on either side of an elevated deck, an inlet to the deck being defined between the two beams; and a climbing wall formed of thermoformed thermoplastic material, the climbing wall being formed of a thermoformed single sheet having a simulated rock face formed thereon and facing outwardly, the climbing wall extending from a base adjacent the ground to the deck, and the simulated rock face having a plurality of integrally formed protruding plastic ledges, the ledges providing surfaces for children to climb on to traverse the climbing wall from ground to the deck inlet, wherein the simulated rock face is narrower adjacent the deck than at the base, wherein each ledge has a tread which protrudes frontwardly for climbing thereon, and wherein the treads are inclined toward the rock face to urge a climber against the rock face rather than away from the rock face.

9. The play assembly of claim 7 wherein the ledges are formed on the simulated rock to alternate between two ledges on a first level, and a single ledge on a level immediately above the first level.

10. The play assembly of claim 7 wherein the climbing wall plastic is formed from a Sheet of polyethylene having a plurality of colored streaks formed therein.

11. The climbing wall assembly of claim 7 wherein at least one ledge is on the side of the climbing wall, the ledge having an upwardly facing surface defining a tread, and a lipextends upwardly from the tread to the side of the tread to restrain a foot placed thereon from moving off the climbing wall.

* * * * *